US009679706B2

(12) United States Patent
Pillet

(10) Patent No.: US 9,679,706 B2
(45) Date of Patent: Jun. 13, 2017

(54) DEVICE FOR DISCONNECTING AN ELECTRICAL SUPPLY LINE WITH A HIGH-INTENSITY CURRENT

(71) Applicant: AMC ETEC, Cannes (FR)

(72) Inventor: Michel Pillet, Cannes (FR)

(73) Assignee: AMC ETEC, Cannes (FR)

( * ) Notice: Subject to any disclaimer, the term of this patent is extended or adjusted under 35 U.S.C. 154(b) by 45 days.

(21) Appl. No.: 14/440,450

(22) PCT Filed: Oct. 31, 2013

(86) PCT No.: PCT/FR2013/000283
§ 371 (c)(1),
(2) Date: May 4, 2015

(87) PCT Pub. No.: WO2014/068201
PCT Pub. Date: May 8, 2014

(65) Prior Publication Data

US 2015/0279579 A1 Oct. 1, 2015

(30) Foreign Application Priority Data

Nov. 5, 2012 (FR) ..... 12 02992

(51) Int. Cl.
*H01H 1/20* (2006.01)
*H01H 1/021* (2006.01)
(Continued)

(52) U.S. Cl.
CPC ..... *H01H 1/20* (2013.01); *H01H 1/021* (2013.01); *H01H 1/023* (2013.01);
(Continued)

(58) Field of Classification Search
CPC .. H01H 50/546; H01H 51/2209; H01H 50/54; H01H 1/20; H01H 1/021; H01H 1/50; H01H 33/596
(Continued)

(56) References Cited

U.S. PATENT DOCUMENTS 3,539,973 A 11/1970 Antes et al. ..... 339/143
3,649,954 A 3/1972 Kurtz ..... 339/95 R
(Continued)

FOREIGN PATENT DOCUMENTS

DE 1 239 752 9/1964
DE 102008017157 10/2009
(Continued)

*Primary Examiner* — Renee S Luebke
*Assistant Examiner* — Ahmed Saeed
(74) *Attorney, Agent, or Firm* — James C. Lydon

(57) ABSTRACT

A disconnecting device having a plurality of modules for disconnecting an electrical supply line of an intensity higher than 1000 A. Each module includes a tight contact casing (10) having at least one fixed-contact conductive element (12, 14) in contact with a mobile-contact conductive element (20, 26), and a mechanism for interrupting the contact between the fixed-contact element and the mobile-contact element so as to disconnect the supply line; metal connection bars (60, 62, and 64, 66) for connecting to a current input and to a current output; and intermediate conductive elements such as blades (68, 70, et 72, 74) connected to the connection bars and to the casing. At least one of the mobile-contact elements includes a silver pellet fixed to the surface of the element, allowing the contact resistance between the mobile-contact element and the fixed-contact element to be reduced by half.

10 Claims, 4 Drawing Sheets

(51) Int. Cl.
*H01H 1/023* (2006.01)
*H01H 33/59* (2006.01)
*H01H 1/50* (2006.01)
*H01R 4/28* (2006.01)

(52) U.S. Cl.
CPC ..... *H01H 33/596* (2013.01); *H01H 1/50* (2013.01); *H01R 4/28* (2013.01)

(58) Field of Classification Search
USPC ..... 200/265–270, 243
See application file for complete search history.

(56) References Cited

U.S. PATENT DOCUMENTS

| | | | | |
|---|---|---|---|---|
| 4,023,882 | A | 5/1977 | Pettersson | 439/426 |
| 4,923,739 | A | 5/1990 | Jin et al. | 428/221 |
| 5,153,818 | A | 10/1992 | Mukougawa et al. | 361/395 |
| 5,360,355 | A | 11/1994 | Ehrler et al. | 439/816 |
| 5,620,290 | A | 4/1997 | Homfeldt | 411/533 |
| 5,857,858 | A | 1/1999 | Gorowitz et al. | 439/86 |
| 5,865,638 | A | 2/1999 | Trafton | 439/288 |
| 5,880,351 | A * | 3/1999 | Orita | G01H 11/06 200/61.51 |
| 6,114,645 | A | 9/2000 | Burgess | 200/512 |
| 6,309,742 | B1 | 10/2001 | Clupper et al. | 428/304.4 |
| 7,044,755 | B2 | 5/2006 | Hatakeyama | 439/97 |
| 7,229,296 | B2 | 6/2007 | Pillet | 439/86 |
| 8,582,305 | B1 * | 11/2013 | Quaife | G06F 1/188 200/17 R |
| 2004/0074338 | A1 | 4/2004 | Kuhn et al. | 75/415 |
| 2005/0042895 | A1 | 2/2005 | Liu | 439/66 |
| 2006/0049027 | A1 * | 3/2006 | Iversen | H01H 39/006 200/61.8 |
| 2006/0204741 | A1 | 9/2006 | Rehbein et al. | 428/304.4 |
| 2006/0270277 | A1 | 11/2006 | Zhao et al. | 439/627 |
| 2009/0295533 | A1 * | 12/2009 | Darr | H01H 9/104 337/194 |
| 2010/0026427 | A1 | 2/2010 | Moeller et al. | 335/71 |
| 2013/0122730 | A1 | 5/2013 | Pillet | 439/271 |
| 2014/0057482 | A1 | 2/2014 | Su et al. | 439/493 |

FOREIGN PATENT DOCUMENTS

| | | |
|---|---|---|
| EP | 2 148 393 | 1/2010 |
| JP | 53-80589 | 7/1978 |
| WO | WO 02/49053 | 6/2002 |

* cited by examiner

DEVICE FOR DISCONNECTING AN ELECTRICAL SUPPLY LINE WITH A HIGH-INTENSITY CURRENT

TECHNICAL FIELD

The present invention relates to devices used to prohibit the power supply when necessary in installations using high-intensity currents, and particularly relates to a device for disconnecting an electrical supply line with a high-intensity current.

PRIOR ART

Regular maintenance operations are required in systems such as electrolysis cells that use high-intensity currents greater than 1000 amperes and up to several tens of thousands of amperes. During these operations, the electrical supply is of course disconnected, but the electrical supply circuit must be opened by means of a disconnecting device to ensure the safety of the operators while the maintenance operations are being carried out.

The vast majority of disconnecting devices currently used consist of blade disconnectors. The blades, rotating about an axis actuated by a suitable mechanism, ensure the electrical connection by applying pressure on current input contacts. Disconnection thus consists in separating the blades from fixed contacts by pivoting them around their axis owing to the actuating mechanism.

Unfortunately, the blade disconnecting devices are heavy and bulky, and as it is impossible to confine such a device in a casing, the device is not tight and therefore subject to rapid degradation by oxidation and dust deposits. There exist disconnecting devices which comprise a casing containing fixed metal contacts on which a mobile metallic contact presses when an actuating mechanism is implemented. While overcoming some of the disadvantages of the blade disconnecting devices, this type of disconnecting device is suitable only for a fixed amount of current. It is thus necessary to resort to devices whose dimensions increase as the amount of current passing through them increases. However, the greatest drawback is the difficulty of dissipating the heat caused by the Joule effect in the contact resistances of the device.

DISCLOSURE OF THE INVENTION

The main purpose of the present invention is thus to provide a disconnecting device for high-intensity current electrical supplies which has maximum conductance.

Another purpose of the invention is to provide a disconnecting device as mentioned above consisting of efficient means for dissipating the heat produced by the Joule effect in the device.

Yet another purpose of the invention is to provide a disconnecting device as mentioned above that is readily adaptable to the intensity value.

A first object of the invention is a disconnecting module of a DC electrical supply line with an intensity greater than 1000 A, comprising:

a tight contact casing comprising at least a first fixed-contact conductive element to establish the electrical connection with a current input and a second fixed-contact conductive element to establish the electrical connection with a current output, the fixed-contact elements being electrically connected on the outside of the casing by two connection terminals respectively, and at least one mobile-contact conductive element adapted to come in contact simultaneously on the first and second fixed-contact elements under the action of an actuating mechanism which is actuated so as to interrupt the contact between the fixed-contact elements and the mobile-contact element with the aim of disconnecting the supply line, at least a first metal connection bar adapted to be connected to a current input and at least a second connection bar adapted to be connected to a current output, and a first intermediate conductive element connected firstly to the first connection bar and secondly to the first fixed conductive element and a second intermediate conductive element connected firstly to the second connection bar and secondly to the second fixed conductive element.

The module is characterised in that the electrical supply line supplies a current of an intensity higher than 1000 A, and at least one of the fixed-contact elements or one of the mobile-contact elements comprises a silver pellet placed on the surface of the element, allowing the contact resistance between the mobile-contact element and the fixed-contact element to be reduced by half.

A second object of the invention is such a disconnecting module used as a presentation model allowing the future user to know the behaviour according to the temperature of a desired disconnecting device.

A third object of the invention is a disconnecting device comprised of a plurality of disconnecting modules as defined above arranged in parallel so as to adapt the device to the intensity value supplied by the electrical supply line.

BRIEF DESCRIPTION OF FIGURES

Other purposes, objects and characteristics of the invention will become more apparent from the following description when taken in conjunction with the accompanying drawings in which.

DETAILED DESCRIPTION OF THE INVENTION

The disconnecting device according to the invention is essentially comprised of one or more disconnecting modules. Each module is adapted to allow the passage of a current of approximately 3000 A. It should be noted that the current is mainly a direct current although it may be an alternating current, and the intensity may be different.

Figure 1:
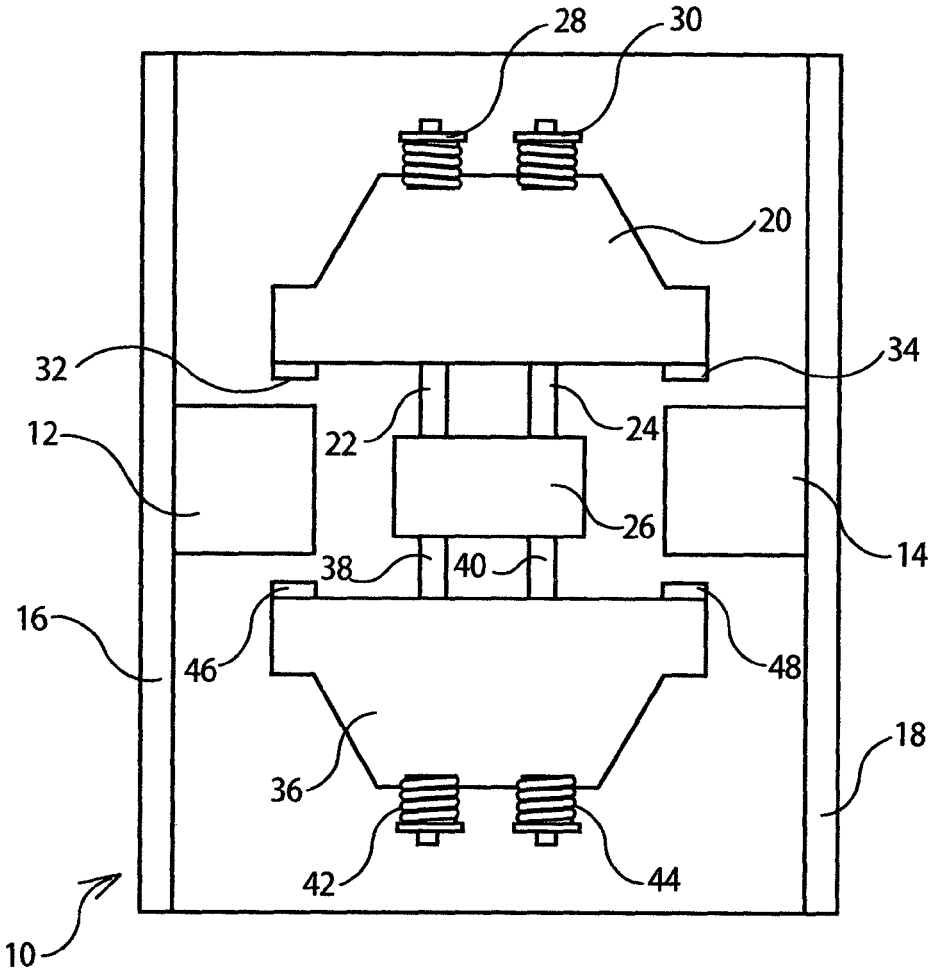
FIG. 1 schematically represents a contact casing used in a disconnecting module according to the invention.

The contact casing 10 of each disconnecting module represented in FIG. 1 is preferably rectangular in shape, measuring approximately 40 cm long and approximately 30 cm wide. The casing 10 is comprised of at least one contact bridge. Each contact bridge comprises two fixed-contact elements 12 and 14, preferably made of aluminium, soldered to two connection terminals, preferably made of aluminium, respectively, the terminals 16 and 18 which constitute the current input and the current output of the casing, connected to the current input and output on the outside of the casing, respectively, as will be discussed below.

Each contact bridge of the casing 10 comprises a mobile-contact element 20, preferably made of aluminium, that is not in contact with the two fixed-contact elements 12 and 14 when the disconnection has been made so as to perform maintenance on the installation comprising the disconnecting device according to the invention.

When the installation is switched back on after the maintenance operation, the contact between the fixed-contact elements 12 and 14 and the mobile-contact element 20 is made by a downward movement of the element 20 by means of rods 22 and 24 actuated by an actuating means 26. The top of the rods 22 and 24 is blocked on the mobile-contact element 20 by two springs 28 and 30. At the end of the downward movement of the element 20, the latter comes into contact with the contact elements 12 and 14 and pressure is exerted by the compression of the springs 28 and 30.

A significant feature of the invention is to provide a disconnecting device that has the lowest possible resistance so as to obtain as little heat dissipation by Joule effect as possible and thus obtain the lowest possible temperature rise.

A first means to achieve this result is to fix, preferably by high temperature brazing, silver pellets 32 and 34, circular in shape for example, on the contact surface of the mobile-contact element 20 which makes contact with the fixed-contact elements 12 and 14. Actually, as the fixed-contact and mobile-contact elements are made of aluminium, the contact resistance between the fixed-contact element and the mobile-contact element would be relatively high. With the presence of the silver pellets 32 and 34, the conductivity of which is high, the resistance is reduced by half or, in other words, the conductance is doubled.

It should be noted that, in the contact casing 10, it is judicious to have two contact bridges and thus a second mobile-contact element 36 which is symmetric to the movable-contact element 20, as shown in FIG. 1. The element 36 is brought into contact with the fixed-contact elements 12 and 14 by means of rods 38 and 40 and springs 42 and 44 actuated by the same operating mechanism 26. In the same manner as above, the mobile-contact element 36 comprises silver pellets 46 and 48 to reduce the contact resistance with the fixed-contact elements 12 and 14.

It should be noted that the contact casing just described presents, for each of the mobile-contact elements 20 and 36, a resistance of approximately 10 μΩ which corresponds to a power of approximately 90 W for a current of intensity equal to about 3000 A.

Figure 2:
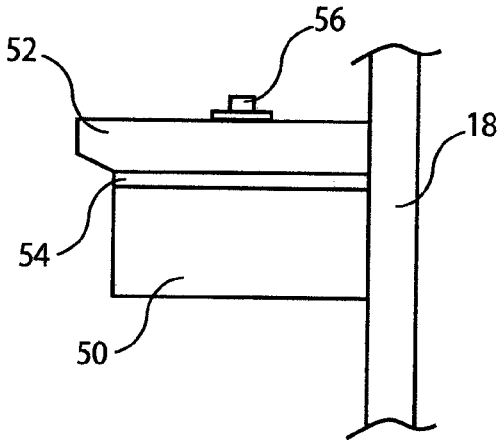
FIG. 2 represents a specific embodiment of a fixed-contact element of the casing.

According to a variant of the invention and for the purpose of limiting the temperature rise by generating the lowest possible heat dissipation by Joule effect, each of the fixed-conductor elements 12 and 14 may be made in the manner illustrated in FIG. 2.

As seen in this Figure, the fixed-contact conductive element 14, which is fixed to the connection terminal 18, comprises a lower layer 50, an upper layer 52 and an intermediate layer 54.

As the connection terminal 18 to which it is attached, by soldering for example, the lower layer 50 is made of aluminium. The upper layer 52 is interchangeable and is fastened to the lower layer by a bolt 56. The upper layer 52 is preferably made of copper so as to deposit a silver coating by electrolysis on its upper surface, which would not be possible if this layer were made of aluminium as the lower layer. Thus, the electrical connection between the mobile element 20 and the fixed element 14 is made by direct contact between the silver pellet 34 and the silver coating of the upper layer 52, which reduces the contact resistance by half.

The intermediate layer, clamped between the lower layer 50 and upper layer 52 by the bolt 56, is preferably a layer of ECOCONTACT (trademark) foam consisting of a metal foam skeleton selected from the group consisting of iron, cobalt, nickel and alloys thereof, coated with at least a coating of tin, indium, or one of their alloys, described in French patent 1002988. Due to the cellular structure of this layer, its surface comprises a plurality of contact points. Owing to these points, the intermediate layer 54 has a plurality of contacts with the upper and lower layers, which enables a high level of conductivity, and thus a low resistance, to be obtained. It is noted that, as previously with the silver pellets, the resistance between the fixed-contact element and movable-contact element is reduced by half.

It should be noted that the fixed-contact conductive element 12 connected to the connection terminal 16 also comprises, in its upper part, a structure identical to the three-layer structure shown in FIG. 2. In the preferred embodiment shown in FIG. 1, a structure with three identical layers, symmetric to that shown in FIG. 2, is also located at the lower parts of each of the fixed-contact elements 12 and 14. It should also be noted that the structure with three identical layers, shown in FIG. 2, can be used on either side of the two lower parts of the fixed-contact element 20 coming into contact with the fixed-contact elements 12 and 14, but also in place of the silver pellet 32, 34.

Although, as far as possible, the contact casing just described is tight, dust can still deposit on the elements that it contains. Such dust deposits, on the silver pellets for example, lead to the deterioration of the contacts which results in an increase in the electrical resistance. Furthermore, electric arcing may occur during disconnection owing to a residual intensity due to a battery-powered supply.

For the reasons just mentioned, a preferred embodiment consists in filling a perfectly tight casing with an inert gas instead of air. Such a gas may be a neutral gas such as helium, neon or nitrogen, and preferably sulphur hexafluoride (SF6).

Another way to reduce the temperature produced by the heat dissipation is to provide for the circulation of a coolant fluid, for example water, in a pipe (not shown) located inside each of the connection terminals 16 and 18.

Figure 3:
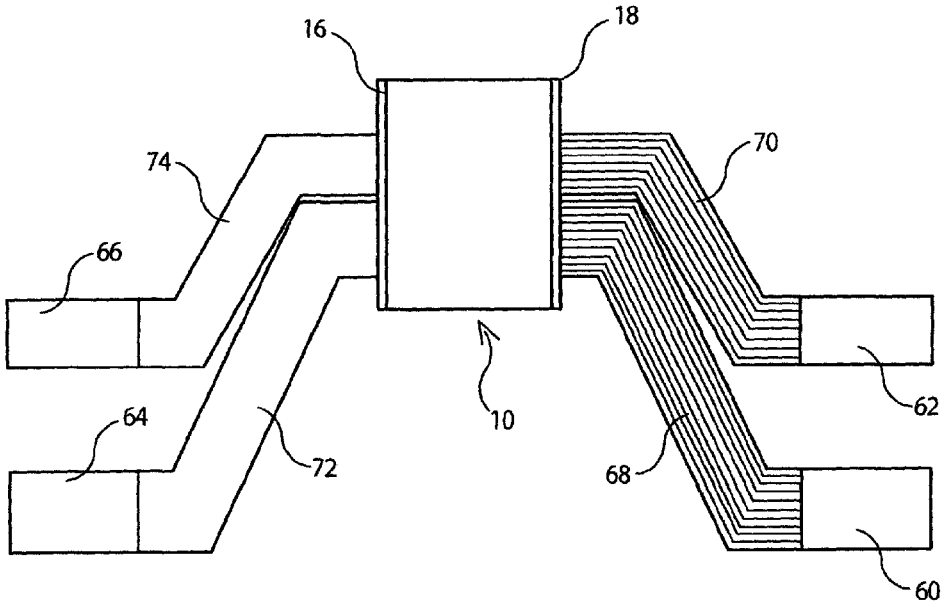
FIG. 3 schematically represents a disconnecting module according to the invention that can be used as a presentation model.

The disconnecting module according to the invention can be made as shown in FIG. 3. Such a module comprises a casing 10, described above, electrically connected to the current input and current output by means of the connection terminals 16 and 18.

The input current and the output current (not shown) are connected to the module by two connection bars 60 and for the current input and two bars 64 and 66 for the current output. As shown in the figure, the connection bars 60 and 62 are connected to the casing 10 by a plurality of connection blades divided into two groups of blades 68 and 70. As already mentioned, a significant feature of the invention is to limit the temperature rise due to heat dissipated by the Joule effect as much as possible. For this purpose, the structure, made of a plurality of blades, has a very large air contact surface area comprised of the two sides of each blade multiplied by the total number of blades. As shown, the blades form a Z so that they have the greatest possible flexibility and can be deformed in both corners of the Z under the effect of temperature.

It should be noted that a plurality of blades having the same structure as for the current input and divided into two assemblies 72 and 74 is used to connect the connection bars 64 and 66.

The disconnecting module, just described in reference to FIGS. 1, 2 and 3, has a rectangular shape whose largest dimension is between 0.90 m and 1.20 m and the smallest dimension between 0.40 m and 0.60 m, and has a thickness of about 3 cm. It weighs between 20 and 30 kg.

As previously mentioned, this module can allow the passage of a current of approximately 3000 A. As the intensity of the current used in the installation is generally greater, the disconnecting device comprises a plurality of such disconnecting modules arranged in parallel.

A significant object of the invention is to use the disconnecting module described above as a presentation model. Actually, as the size and weight of a module is relatively low, it is easy for the manufacturer to transport only the module so as to present it to a potential client or prospective user. The latter may thus, using a low intensity current, rapidly define how many modules will be necessary in the desired disconnecting device and determine the temperature behaviour of said disconnecting device.

Generally speaking, a disconnecting device according to the invention comprises a plurality of modules which are assembled in parallel to match the intensity of the current to be disconnected. Thus, if the current has an intensity of 20 kA, eight disconnecting modules in parallel must be provided for. The resulting disconnecting device thus comprises a single connection terminal, preferably made of aluminium, for an electrical connection on the outside of all the modules.

Figure 4:
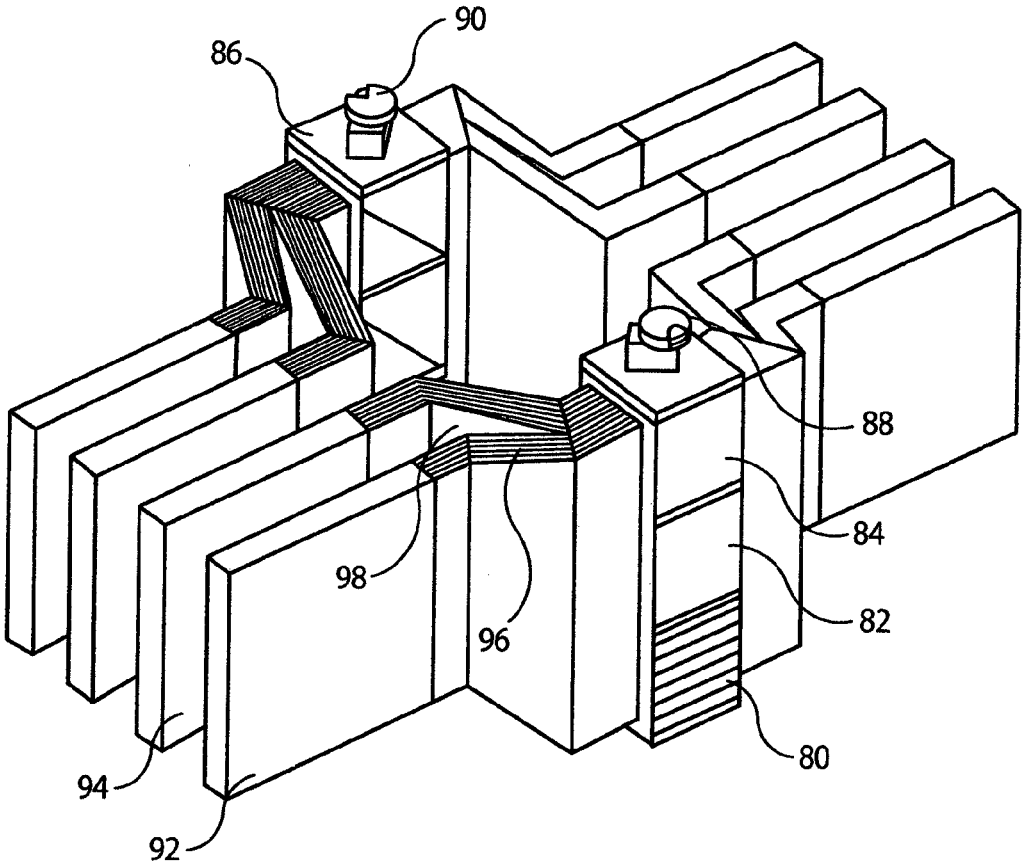
FIG. 4 schematically represents a disconnecting device according to the invention comprising a plurality of disconnecting modules illustrated in FIG. 3.

FIG. 4 shows a disconnecting device used for an intensity of approximately 120 kA composed of six partial disconnecting devices comprised of two assemblies of three sub-assemblies 80, 82 and 84 of eight modules each, such as the sub-assembly 80. To this end, each module, shown in FIG. 3, of each of the three sub-assemblies is opposite a module which is symmetric to it and which belongs to a sub-assembly of the other assembly. Thus, the modules of the sub-assembly 84 are symmetric to the modules of the subassembly 86.

The three sub-assemblies or partial disconnecting devices 80, 82 and 84 have a common actuating mechanism 88. The same is true for the three sub-assemblies or symmetrical partial disconnecting devices, which have the same actuating mechanism 90. This mechanism is, for example, a rotating mechanism of a shaft which, by a set of connecting rods, drives in compression the springs described in reference to FIG. 1 and allows the contacts inside the casing to pass the current.

All of the partial disconnecting devices 80, 82 and which, in FIG. 4, comprise only one connection terminal, are connected to the current input by two connection bars 92 and 94 and through two sets of connection blades 96 and 98. The same connecting structure (not referenced), i.e. two bars connected to the output connection terminal, is used for the connection to the current output. The same structure (not referenced) as that just described is symmetric to the latter and includes all of the partial disconnecting devices which are symmetric to the partial disconnecting devices 80, 82 and 84.

Figure 5:
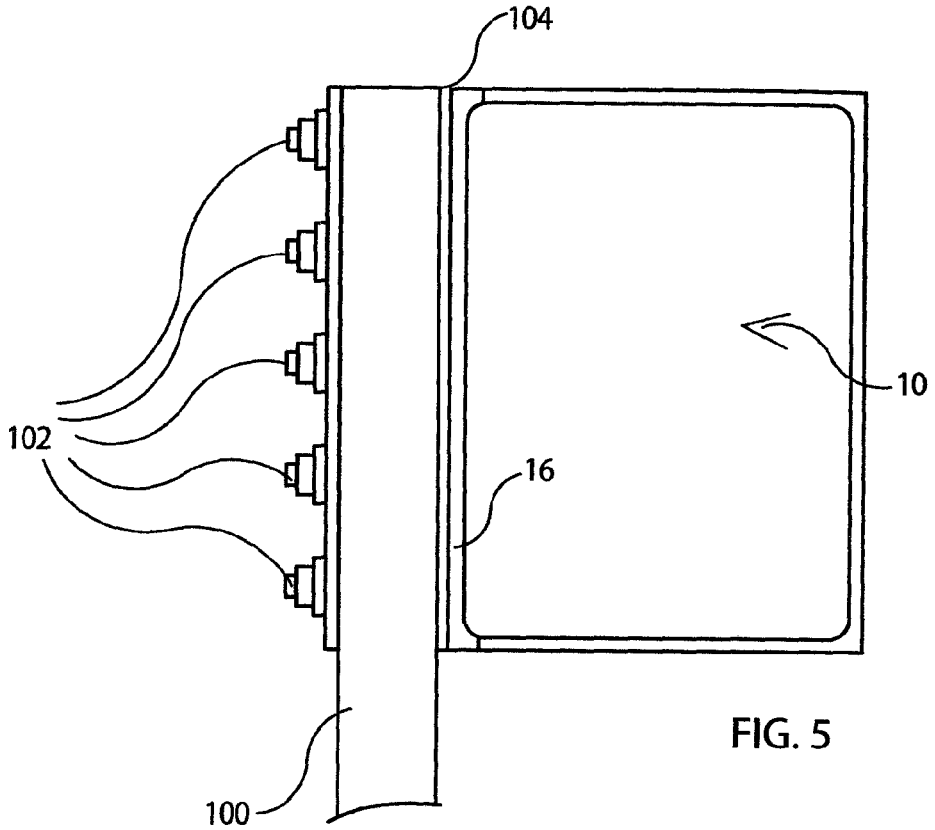
FIGS. 5 and 6 represent variants of the disconnecting module wherein the connection bars are connected to the contact casing by a layer of foam consisting of a metal foam skeleton such as iron, cobalt, nickel and alloys thereof covered with a coating of tin, indium or one of their alloys (ECOCONTACT).
Figure 6:
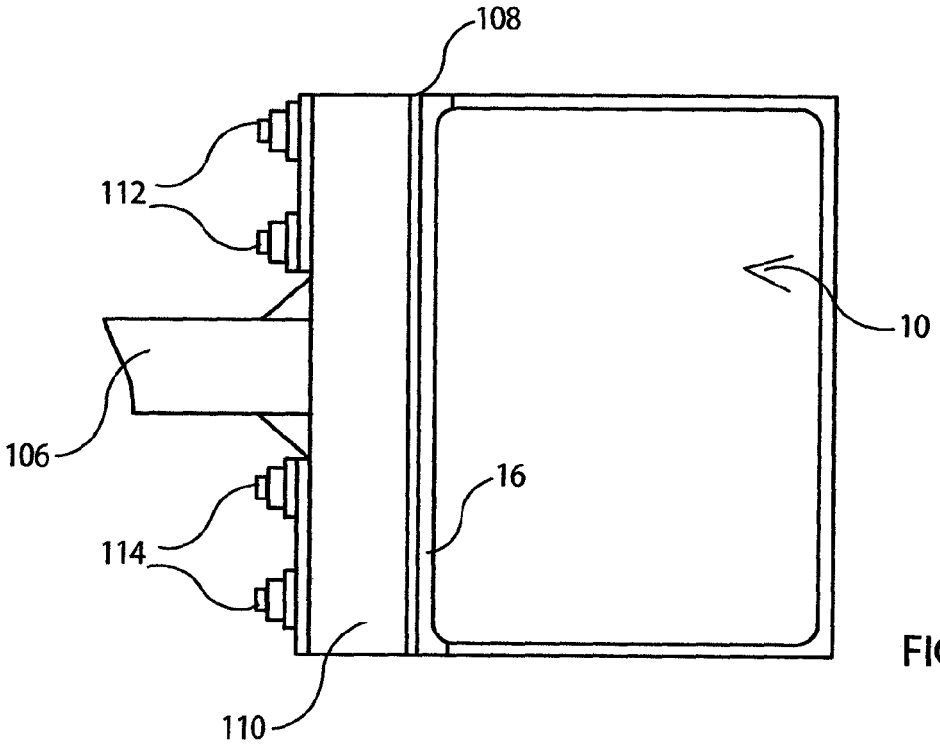

According to a variant of the invention, the sets of connection blades designed to dissipating the heat produced by Joule effect, are replaced by the devices shown in FIGS. 5 and 6.

In FIG. 5, the connection bar is attached directly to the connection terminal 16 (or 18) by bolts 102. A layer of ECOCONTACT (trademark) foam 104 is located between the connection bar 100 and the connection terminal. This layer consists of a metal foam skeleton selected from the group consisting of iron, cobalt, nickel and alloys thereof, coated with at least a coating of tin, indium or an alloy thereof. As mentioned previously, the surface of the layer has a plurality of contact points. Owing to these points, the layer 104 has a plurality of contacts with the connection bar 100 and with the connection terminal 16, which enables a high level of conductivity, and thus a low resistance, to be obtained.

In FIG. 6, the connection bar 106 is connected to the connection terminal 16 by means of an intermediate bar 110 to which it is soldered. The intermediate bar 110 is attached to the connection terminal 16 by means of bolts 112 and 114. Between the bar 110 and the connection terminal, there is a layer of ECOCONTACT foam as in the embodiment shown in FIG. 5.

The invention claimed is:

1. A disconnecting module comprising:

a tight contact casing (10) comprising at least a first fixed-contact conductive element (12) to establish an electrical connection with a current input and a second fixed-contact conductive element (14) to establish an electrical connection with a current output, said first and second fixed-contact elements being electrically connected on an outside of the casing by two connection terminals (16, 18) respectively, and at least one mobile-contact conductive element (20 or 36) adapted to come in contact simultaneously on said first and second fixed-contact elements under the action of an actuating mechanism (26), said mechanism being actuated so as to interrupt the contact between said fixed-contact elements and said mobile-contact element with the aim of disconnecting said electrical power supply line, at least a first metal connection bar adapted to be connected to a current input and at least a second connection bar adapted to be connected to a current output, and a first intermediate conductive element connected firstly to said first connection bar and secondly to said first fixed conductive element and a second intermediate conductive element connected firstly to said second connection bar and secondly to said second fixed conductive element;

wherein said electrical power supply line supplies a current of an intensity higher than 1000 A, at least one of said fixed-contact elements (12, 14) or one of said mobile-contact elements (20 or 26) comprises a silver pellet placed on a surface thereof, allowing a contact resistance between the mobile-contact element and the fixed-contact element to be reduced by half, wherein at least one of said fixed-contact elements (12 or 14) comprises a lower layer made of aluminum (50), an upper layer made of copper having a silver coating (52) and an intermediate layer (54) of foam comprising a metal foam skeleton selected from the group consisting of iron, cobalt, nickel and alloys thereof coated with at least a coating selected from the group consisting of tin, indium and one of their alloys.

2. The disconnecting module according to claim 1, wherein a silver pellet is fixed on a surface of each of said mobile-contact elements (20, 26) coming into contact with each of said fixed-contact elements (12, 14).

3. The disconnecting module according to claim 1, wherein said tight contact casing (10) is filled with an inert gas.

4. The disconnecting module according to claim 3, wherein said gas is a neutral gas.

5. The disconnecting module according to claim 1, wherein said first intermediate conductive element and said second intermediate conductive element are both comprised of at least one group of connection blades (68, 70 and 72, 74).

6. The disconnecting module according to claim 5, wherein said connection blades (68, 70 and 72, 74) form a Z.

7. The disconnecting module according to claim 1, wherein said first intermediate conductive element and said second intermediate conductive element comprise a layer (104, 108) of foam comprising a metal foam skeleton selected from the group consisting of iron, cobalt, nickel and alloys thereof covered with at least a coating of tin, indium or one of their alloys.

8. The disconnecting module according to claim 1, wherein the current supplied by said electric power supply line is direct current.

9. A disconnecting device comprising a plurality of disconnecting modules according to claim 1 arranged in parallel between the current input and the current output.

10. The disconnecting module according to claim 4, wherein said neutral gas is a member of the group consisting of helium, neon, nitrogen and sulphur hexafluoride ($SF_6$).

* * * * *